US010065790B2

(12) United States Patent
Van Herpen

(10) Patent No.: US 10,065,790 B2
(45) Date of Patent: Sep. 4, 2018

(54) CAP-HELD TILT ACTUATOR FOR A FOAM DISPENSER

(71) Applicant: TREMCO ILLBRUCK PRODUCTIE B.V., Arkel (NL)

(72) Inventor: Goslin Van Herpen, Hardinxveld-Giessendam (NL)

(73) Assignee: Tremco Illbruck Productie B.V. (NL)

( * ) Notice: Subject to any disclaimer, the term of this patent is extended or adjusted under 35 U.S.C. 154(b) by 75 days.

(21) Appl. No.: 14/577,409

(22) PCT Filed: Jun. 21, 2013

(86) PCT No.: PCT/EP2013/063014
§ 371 (c)(1),
(2) Date: Dec. 19, 2014

(87) PCT Pub. No.: WO2014/001218
PCT Pub. Date: Jan. 3, 2014

(65) Prior Publication Data

US 2015/0284176 A1 Oct. 8, 2015

(30) Foreign Application Priority Data

Jun. 26, 2012 (DE) ..... 20 2012 102 354 U
Jan. 29, 2013 (DE) ..... 20 2013 100 408 U

(51) Int. Cl.
*B65D 83/20* (2006.01)
*B65D 83/46* (2006.01)
*B65D 83/30* (2006.01)

(52) U.S. Cl.
CPC ..... *B65D 83/206* (2013.01); *B65D 83/306* (2013.01); *B65D 83/46* (2013.01)

(58) Field of Classification Search
CPC ..... B65D 83/14; B65D 83/16; B65D 83/46; B65D 83/206; B65D 83/50; B65D 83/306;
(Continued)

(56) References Cited

U.S. PATENT DOCUMENTS 2,814,404 A * 11/1957 Towns ..... B65D 41/28 215/305
2,852,168 A * 9/1958 Suellentrop ..... B65D 83/46 222/402.22
(Continued)

FOREIGN PATENT DOCUMENTS

DE 3744440 C2 7/1988
DE 9102677 U1 7/1992
(Continued)

OTHER PUBLICATIONS

National Search Report for DE 202013100408.1, dated Mar. 22, 2013.
(Continued)

*Primary Examiner* — Nicholas J Weiss
*Assistant Examiner* — Andrew P Bainbridge
(74) *Attorney, Agent, or Firm* — Calfee, Halter & Griswold LLP

(57) ABSTRACT

The invention relates to a system consisting of a cap for fastening on a foam can, or generally on a container, that contains a pressurized or pressurizable medium, as well as a tilting valve and a dispenser. The tilting valve comprises a sealing part that can be connected to the container and a valve nozzle interacting with the sealing part. The cap can be fastened on the container in the area of the tilting valve. The dispenser has a fastening area by means of which it can be fastened on the valve nozzle through a central opening of the cap. For easy mounting of the dispenser on the valve and for
(Continued)

Figure 1:
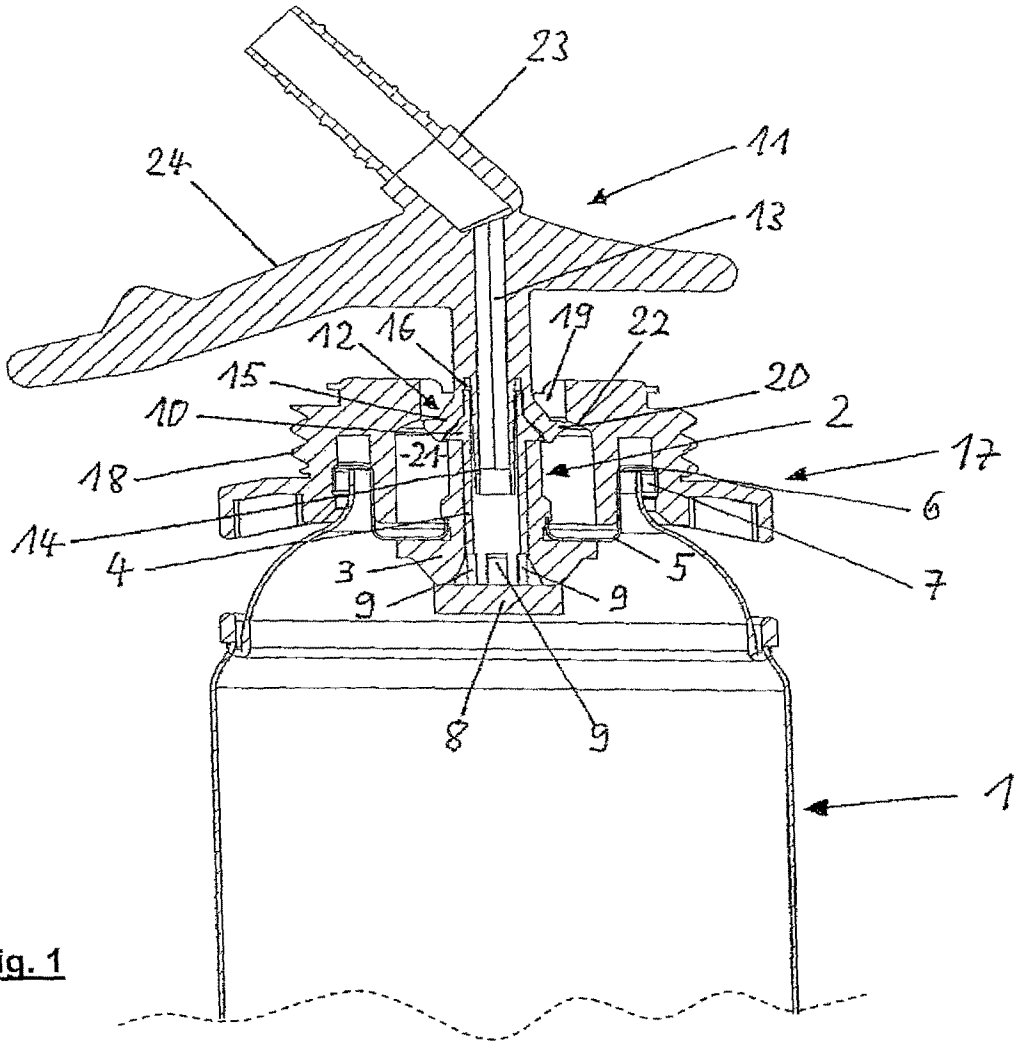

its actuation, provision is made for the inner area of the opening of the cap and the outer area of the fastening area of the dispenser to display positively interacting areas that, in tilted position of the dispenser relative to the container, create a positive fit opposing removal of the dispenser in the axial direction of the tilted position and detachment of the fastening area of the dispenser from the valve nozzle of the tilting valve.

17 Claims, 8 Drawing Sheets

(58) Field of Classification Search
CPC ... B05B 9/04; B05B 9/01; B05B 9/08; A01M 7/00
USPC ..... 222/153.09–153.1, 542, 402.21–402.24
See application file for complete search history.

(56) References Cited

U.S. PATENT DOCUMENTS 2,889,086 A * 6/1959 Collins ..... B65D 83/46 222/402.16
3,933,283 A * 1/1976 Hoagland ..... B65D 83/205 222/402.13
4,008,834 A * 2/1977 Towns ..... B65D 83/46 222/402.23
5,549,228 A * 8/1996 Brown ..... B65D 83/207 222/402.1
6,827,239 B2 * 12/2004 Lasserre ..... B65D 83/46 222/153.11
9,079,675 B2 * 7/2015 Vervoort ..... B65D 83/201
2002/0056733 A1 * 5/2002 Lasserre ..... B65D 83/205 222/402.21
2009/0174183 A1 7/2009 Puusaag et al.
2012/0138639 A1 * 6/2012 Scheindel ..... B65D 83/46 222/402.22
2014/0048568 A1 * 2/2014 Demey ..... B65D 83/202 222/402.22
2015/0284176 A1 * 10/2015 Van Herpen ..... B65D 83/206 222/153.09

FOREIGN PATENT DOCUMENTS

DE 29817001 U1 3/1999
EP 1205403 A1 5/2002
JP 2000203667 A 7/2000
JP 2002080077 A 3/2002
JP 2007302338 A 11/2007
JP 2012106750 A 6/2012
WO 2011151295 A1 12/2011

OTHER PUBLICATIONS

International Preliminary Report on Patentability and Written Opinion of the International Searching Authority for PCT/EP2013/063014, dated Oct. 23, 2013.
International Search Report for PCT/EP2013/063014, dated Oct. 23, 2013.

* cited by examiner

CAP-HELD TILT ACTUATOR FOR A FOAM DISPENSER

The invention relates to a system consisting of a cap for fastening on a foam can, or generally on a container, that contains a pressurised or pressurisable medium, where the container displays a tilting valve comprising a sealing part that can be connected to the container and a valve nozzle interacting with the sealing part, and the cap can be fastened on the container in the area of the tilting valve, and of a dispenser having a fastening area by means of which it can be fastened on the valve nozzle through a central opening of the cap, such that the tilting valve can be actuated by tilting movement of the dispenser.

A system consisting of a cap of this kind and a dispenser of this kind is known from the prior art. The cap serves to fasten a commercially available spray gun on the container, e.g. the spray can. To this end, the outer circumference of the cap displays an external thread, onto which the spray gun can be screwed by means of an internal thread located in the area of its upstream end. Spray guns are primarily used professionally, call for stable fastening on the container by means of the cap, and permit simple replacement of an empty container by a full one. For certain applications, especially in the non-professional field, it is expedient to use simpler, manually tiltable dispensers on a spray can for applying or injecting the medium to be sprayed or injected, e.g. into joints. In order to be able to use containers with the same cap fastened to them to this end, the cap and the dispenser are designed in such a way that the dispenser can, by means of its fastening area, be fastened on the valve nozzle of the tilting valve provided on the container through the central opening of the cap, and tilting movement of the dispenser for actuating the tilting valve is possible.

The object of the present invention is to provide a system consisting of a cap and a dispenser for a spray can, where the dispenser can be fitted onto the valve nozzle of the tilting valve in simple fashion through the opening of the cap by means of its fastening area, and removed from the valve nozzle and the opening of the cap, and where a secure hold of the dispenser on the valve nozzle is ensured when the tilting valve is actuated by tilting the dispenser.

On a system consisting of cap and dispenser of the kind mentioned in the opening paragraph, the object is solved in that the inner area of the opening of the cap and the outer area of the fastening area of the dispenser display positively interacting areas that, in tilted position of the dispenser relative to the container, create a positive fit opposing removal of the dispenser in the axial direction of the tilted position and detachment of the fastening area of the dispenser from the valve nozzle of the tilting valve.

With the help of the invention, an effective positive fit is enabled in the position (tilted position) of the dispenser in which the tilting valve is actuated and the medium to be sprayed or injected enters the inner channel of the dispenser through the valve nozzle under pressure. In this position, the dispenser cannot detach itself from the tilted valve nozzle in the axial direction of the latter. A tilting valve is generally characterised in that it is opened by the tilting movement alone, such that the inner channel of the dispenser is not under pressure in the axial orientation of the dispenser. When the tilting valve is not tilted, there is thus no risk of the dispenser becoming detached from the valve nozzle due to exposure to pressure by the medium.

In a preferred embodiment of the invention, the areas of the cap and of the fastening area of the dispenser that create a positive fit upon tilting movement of the dispenser are designed in such a way that the inner side of the opening of the cap displays a radial undercut in the direction of the tilting movement of the dispenser, and the dispenser is provided with a projection in its fastening area that engages the undercut during fastening of the dispenser on the valve nozzle and actuation of the tilting valve by tilting movement of the dispenser.

Other embodiments of the positive fit according to the invention during tilting movement of the dispenser are easily conceivable. For example, the fastening area of the dispenser can display a groove that is engaged by a projection located on the inner side of the opening of the cap during tilting movement of the dispenser.

For simple fastening and detaching of the dispenser on and from the valve nozzle, the edge of the opening of the cap and the fastening area of the dispenser are expediently designed in such a way that the dispenser can be passed through the opening in the axial direction relative to the opening and the container, in which the tilting valve is not actuated, by means of its fastening area and fastened on the valve nozzle, and can be removed from the valve nozzle through the opening.

In a preferred embodiment of the invention, the diameter of the opening of the cap is roughly equal to, or greater than, the maximum outside diameter of the fastening area of the dispenser. The opening can be of circular design with a constant diameter in this context. In the case of a non-circular opening, the maximum diameter of the opening of the cap can be designed to be roughly equal to, or greater than, the maximum outside diameter of the fastening area of the dispenser.

According to a preferred development of the invention, the inner area of the opening of the cap and the outer area of the fastening area of the dispenser with the interacting areas are designed to be rotationally symmetrical in relation to the longitudinal axis of the opening of the cap.

In particular, the undercut provided on the inner side of the opening of the cap in the aforementioned embodiment, and the projection provided on the fastening area of the dispenser, can be designed to be rotationally symmetrical in relation to the longitudinal axis of the opening of the cap. The projection can be designed as an annular flange around the fastening area in this context. The flange can extend continuously around the fastening area in the circumferential direction. Alternatively, it can also be provided with interruptions.

Furthermore, the inner area of the opening of the cap and the outer area of the fastening area of the dispenser with the interacting areas can be designed in such a way that the interacting areas form the positive fit with only very little or no play when the cap is fastened on the container and the dispenser is fastened on the valve nozzle, and during tilting movement of the dispenser for actuating the tilting valve.

In the aforementioned embodiment, provision can particularly be made for the projection to reach under the undercut with very little or no play when the cap is fastened on the container and the dispenser is fastened on the valve nozzle, and during tilting movement of the dispenser for actuating the tilting valve.

The inner area of the opening of the cap and the outer area of the fastening area of the dispenser can be designed in such a way that the interacting areas engage each other in sliding fashion during tilting movement of the dispenser for actuating the tilting valve, creating the positive fit in the process.

In the aforementioned embodiment, the projection on the fastening area of the dispenser can particularly reach under the undercut of the inner area of the opening of the cap in sliding fashion.

In a preferred embodiment, the fastening area of the dispenser displays a tubular area, projecting upstream, that can be fastened by means of an interference fit in a tubular end area, projecting downstream, of the valve nozzle of a standard tilting valve.

The tubular area of the fastening area of the dispenser can be designed in such a way that its outside diameter decreases towards the upstream end.

Furthermore, the tubular area of the fastening area of the dispenser can be designed in such a way that, when the dispenser is fastened on the valve nozzle by means of an interference fit, the dispenser cannot be detached from the valve nozzle in its tilted position, even when not using the cap.

In one embodiment of the invention, the fastening area of the dispenser can display a conical area, widening towards its upstream end, on the end of which is located the area interacting with the cap to create the positive fit.

The fastening area of the dispenser can display an annular groove, open towards its upstream end, that is located between the conical area and the tubular area and designed in such a way that a tubular end area, projecting downstream, of the valve nozzle of a standard tilting valve can be inserted into it with an interference fit.

The conical area of the fastening area of the dispenser can be designed as a conical tubular area whose inside diameter increases towards the upstream end. The conical area can thus be adapted to a conical annular flange of the valve nozzle that lies on the downstream face end of the sealing part of the tilting valve under pretension.

In addition to the system comprising a cap and a dispenser according to the embodiments described above, the invention also encompasses a container, in which a pressurised or pressurisable medium is located and which displays a tilting valve comprising a sealing part connected to the container and a valve nozzle interacting with the sealing part, where the cap is fastened on the container in the area of the tilting valve and the dispenser is fastened on the valve nozzle by means of its fastening area, such that the tilting valve can be actuated by tilting movement of the dispenser.

The invention also extends to a cap for fastening on a container in which a pressurised or pressurisable medium is located, where the container displays a tilting valve comprising a sealing part that can be connected to the container and a valve nozzle interacting with the sealing part, and the cap can be fastened on the container in the area of the tilting valve, where a dispenser can be fastened on the valve nozzle through a central opening of the cap by means of a fastening area, such that the tilting valve can be actuated by tilting movement of the dispenser, and where the inner area of the opening of the cap displays means for creating a positive fit, by means of which, in the tilted position of the dispenser relative to the container and together with the fastening area of the dispenser, a positive fit can be created that opposes removal of the dispenser in the axial direction of the tilted position and detachment of the fastening area of the dispenser from the valve nozzle.

In a preferred embodiment, the means for creating a positive fit in the inner area of the opening of the cap is designed as a radial undercut, in which a projection, located on the fastening area of the dispenser, can be engaged during fastening of the dispenser on the valve nozzle and actuation of the valve nozzle by tilting movement of the dispenser.

In a preferred development of the invention, the inner area of the opening with the means for creating a positive fit is designed to be rotationally symmetrical in relation to the longitudinal axis of the opening of the cap.

The invention furthermore relates to a dispenser for a container in which a pressurised or pressurisable medium is located, where the container displays a tilting valve comprising a sealing part that can be connected to the container and a valve nozzle interacting with the sealing part, where the dispenser can be fastened on the valve nozzle by means of a fastening area, such that the tilting valve can be actuated by tilting movement of the dispenser, and where a cap can be fastened on the container in the area of the tilting valve, said cap displaying a central opening, through which the dispenser can be fastened on the valve nozzle by means of its fastening area.

On a dispenser of this kind, provision is made for the outer area of its fastening area to display means for creating a positive fit, by means of which, in the tilted position of the dispenser relative to the container and together with the cap, a positive fit can be created that opposes removal of the dispenser in the axial direction of the tilted position and detachment of the fastening area of the dispenser from the valve nozzle of the tilting valve.

In a preferred embodiment, the means for creating a positive fit can display a projection, pointing radially outwards, that engages an undercut, provided on the inner side of the opening of the cap, during fastening of the dispenser on the valve nozzle and actuation of the tilting valve by tilting movement of the dispenser.

In an expedient development of the invention, the means for creating a positive fit on the fastening area of the dispenser can be designed to be rotationally symmetrical in relation to the longitudinal axis of the fastening area.

In particular, the projection can be designed as an annular flange around the fastening area. The flange can extend continuously around the fastening area in the circumferential direction. Alternatively, it can also be provided with interruptions.

The fastening area of the dispenser can display a tubular area, projecting upstream, that can be fastened be means of an interference fit in a tubular end area, projecting downstream, of the valve nozzle of a standard tilting valve.

The tubular area of the fastening area of the dispenser can be designed in such a way that its outside diameter decreases towards the upstream end.

Furthermore, the tubular area of the fastening area of the dispenser can be designed in such a way that, when the dispenser is fastened on the valve nozzle by means of an interference fit, the dispenser cannot be detached from the valve nozzle in its tilted position, even when not using the cap.

In one embodiment of the invention, the fastening area of the dispenser can display a conical area, widening towards its upstream end, on the end of which is located the means for creating a positive fit interacting with the cap to create the positive fit.

The fastening area of the dispenser can display an annular groove, open towards its upstream end, that is located between the conical area and the tubular area and designed in such a way that a tubular end area, projecting downstream, of the valve nozzle of a standard tilting valve can be inserted into it with an interference fit.

The conical area of the fastening area of the dispenser can be designed as a conical tubular area whose inside diameter increases towards the upstream end. This area can be adapted to a conical annular flange of the valve nozzle that lies on the downstream face end of the sealing part of the tilting valve under pretension.

Alternatively or in addition to the preferred embodiments of the invention described above, a development of the invention extends to a system consisting of a cap and a dispenser, where the cap displays first bayonet-type locking means on the edge of its opening, and the fastening area of the dispenser displays second bayonet-type locking means, with which it can be passed unimpeded through the opening of the cap and placed on the valve nozzle in a first position relative to the cap, and interacts with the first bayonet-type locking means of the cap by being rotated about its longitudinal axis relative to the cap, into a second position in which tilting movement of the dispenser into its tilted position can be performed. The maximum diameter of the opening of the cap can be designed to be roughly equal to, or greater than, the maximum outside diameter of the fastening area of the dispenser.

To this end, the first bayonet-type locking means on the edge of the opening of the cap can be designed in such a way that the second bayonet-type locking means of the fastening area of the dispenser reach below the edge of the opening of the cap when rotated into its second position.

In a preferred development of this embodiment, the fastening area of the dispenser displays two radial projections, diametrically opposite each other in relation to the longitudinal axis, which reach below the edge of the opening of the cap in the second position of the dispenser.

The projections on the fastening area of the dispenser are expediently arranged at a circumferential angle of 90° relative to an actuating arm, located on the dispenser, for actuating the tilting movement of the dispenser relative to the cap.

In a preferred embodiment where, as described above, an annular flange is provided around the fastening area of the dispenser, the two diametrically opposite projections can be located on the annular flange of the fastening area. The fastening area of the dispenser can otherwise be designed as described above. In particular, the fastening area can display a conical area, widening towards its upstream end, on the upstream end of which there follows an area in the form of a cylindrical jacket that extends over a downstream end area of the sealing part when the dispenser is fastened on the valve nozzle. Ribs can be provided between the annular flange and the cylindrical area.

According to a preferred development, the projections are designed in the form of radially outward-lying ends of two webs running radially on the downstream-facing side of the annular flange. The radially inward-facing ends of the webs can be connected to the conical area.

Upstream of the projections can extend webs whose radially outer sides serve as insertion aids when inserting the fastening area of the dispenser into the opening of the cap. The radially outer sides of the webs can be inclined radially inwards in the upstream direction.

In a preferred embodiment, the webs are located on the radial outer side of plate-like parts that are integrally moulded on the upstream-facing side of the annular flange of the fastening part.

In particular, two webs, arranged laterally to the projections, can in each case extend upstream from the projections.

The first bayonet-type locking means of the cap, interacting with the second bayonet-type locking means of the dispenser described above, can be designed as follows.

The inner edge area of the opening of the cap preferably displays a radially inward-facing area extending over an angle of less than 180° in the circumferential direction of the opening, where the diameter of the opening is narrower in this area. Said area interacts as a bayonet-type locking means with the bayonet-type locking means of the dispenser in such a way that the latter reach under the aforementioned, radially inward-facing area of the edge of the opening in the second position of the dispenser, in which tilting movement of the dispenser can be performed.

In a preferred development, the aforementioned area encompasses two diametrically opposite, radially inward-facing projections in the inner edge area of the opening. The projections can be arranged in essentially mirror-symmetrical fashion relative to the plane in which tilting movement of the dispenser, inserted into the opening and fitted onto the valve nozzle, can be performed.

The projections in each case preferably extend over an angle of between 30° and 150° in the circumferential direction of the opening. Particularly expedient is an angle of between 90° and 130°.

In a preferred development, the downstream end area of the edge of the opening displays a downstream-facing conical constriction, where a depression extending over the opening is provided on the downstream-pointing face end of the cap, such that the diameter of the opening in the area of the depression is greater than the diameter of the opening beyond the depression.

The depression can be arranged in essentially mirror-symmetrical fashion relative to the plane lying axially to the opening and perpendicularly to the plane in which the tilting movement of the dispenser is performed.

The depression can also be designed to be essentially mirror-symmetrical relative to the plane in which the tilting movement of the dispenser is performed.

The depression preferably extends beyond the aforementioned face end of the cap in the radial direction.

The edges of the depression facing in the circumferential direction of the opening preferably run in an essentially parallel direction.

In an advantageous embodiment, the area of the edge of the opening displaying the conical constriction is provided with a circumferential undercut on its upstream end. The purpose of the undercut is that, as described above, a projection located on the fastening area of the dispenser can engage the undercut during fastening of the dispenser on the valve nozzle and tilting movement of the dispenser, as described above, thus ensuring additional protection against removal of the dispenser from the opening of the cap in the tilted position of the dispenser, in addition to the bayonet-type connection between dispenser and cap described above.

Figure 2:
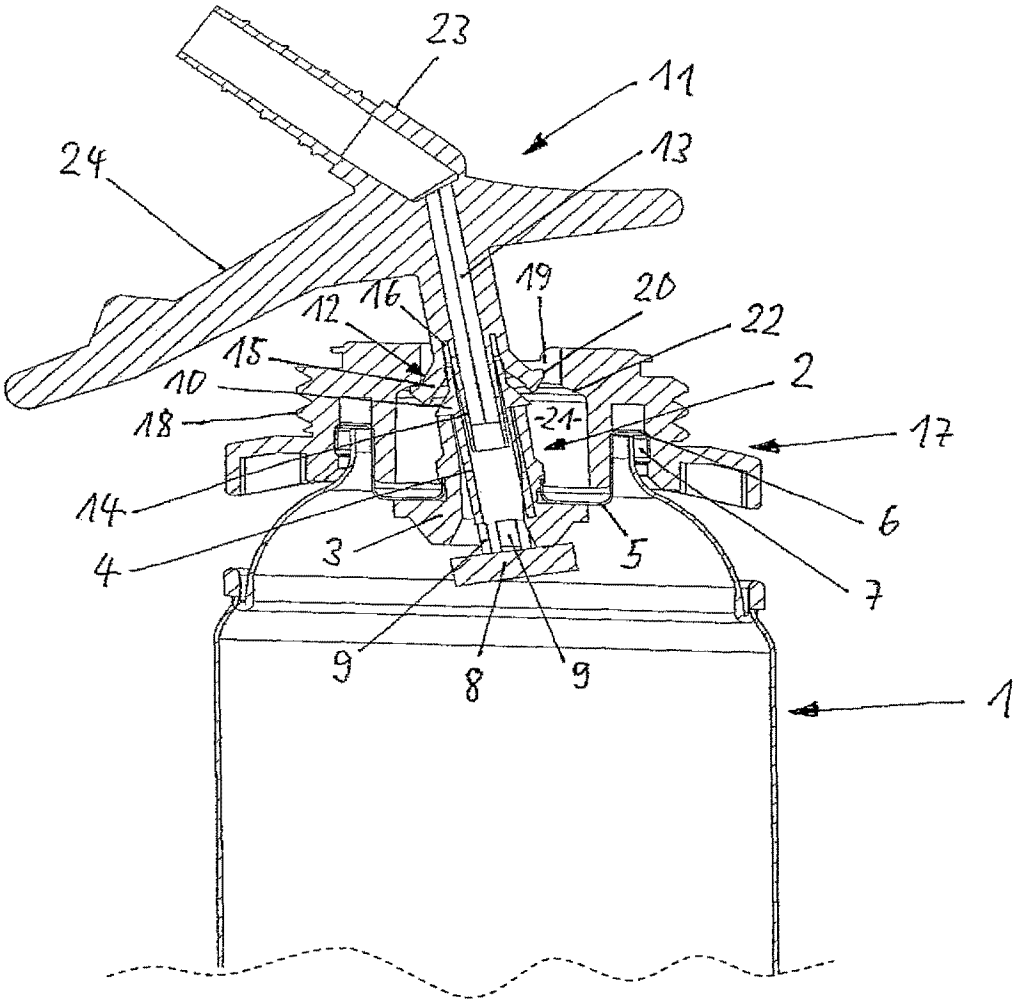
Figure 4:
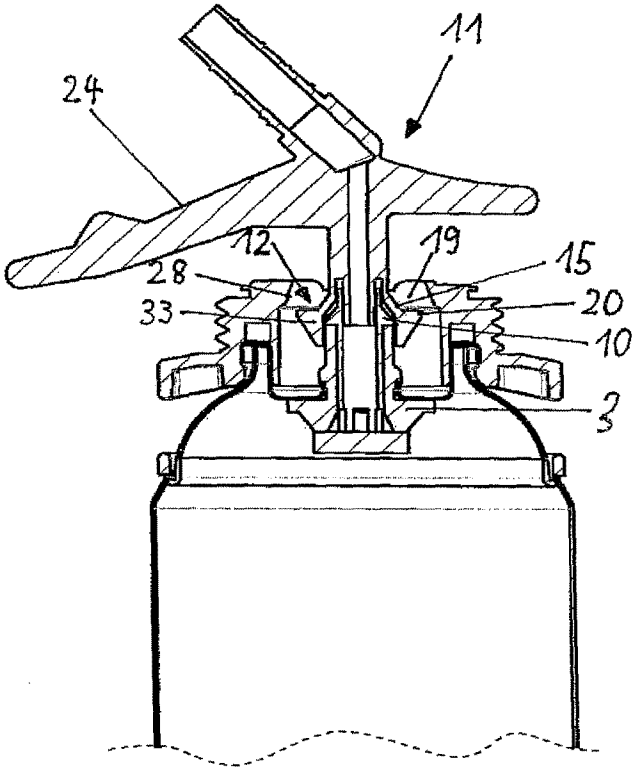
Figure 3:
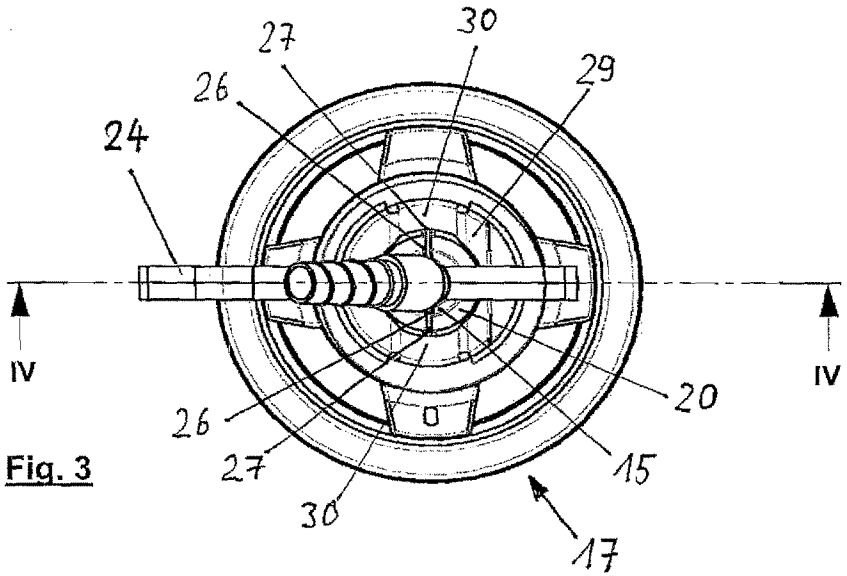
Figure 6:
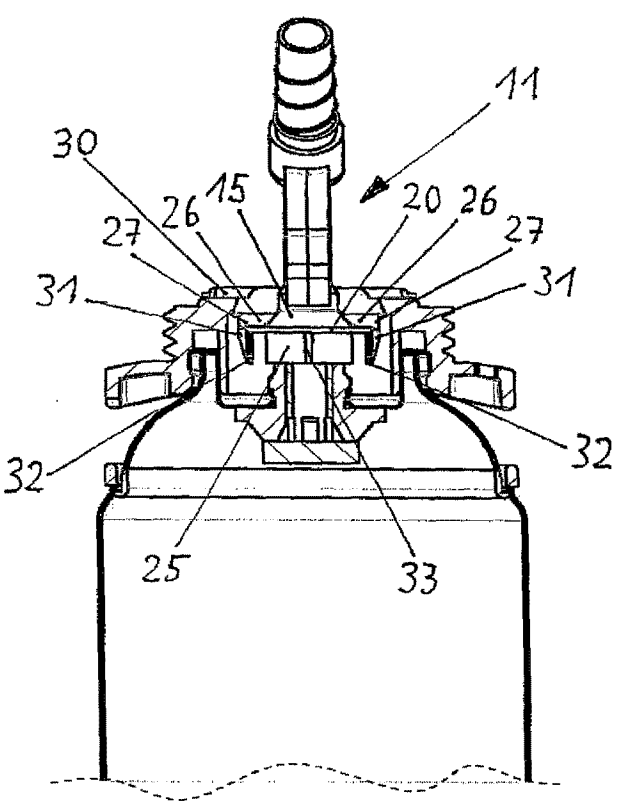
Figure 5:
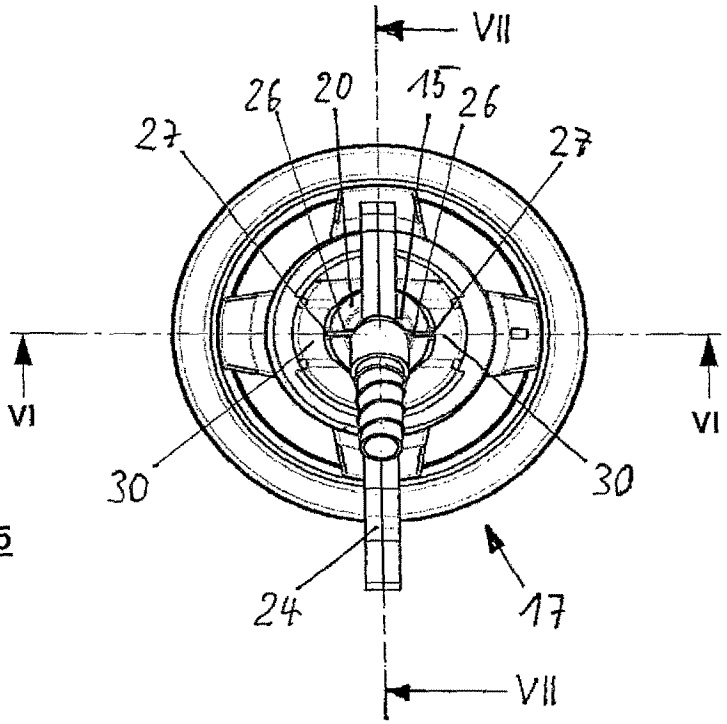
Figure 7:
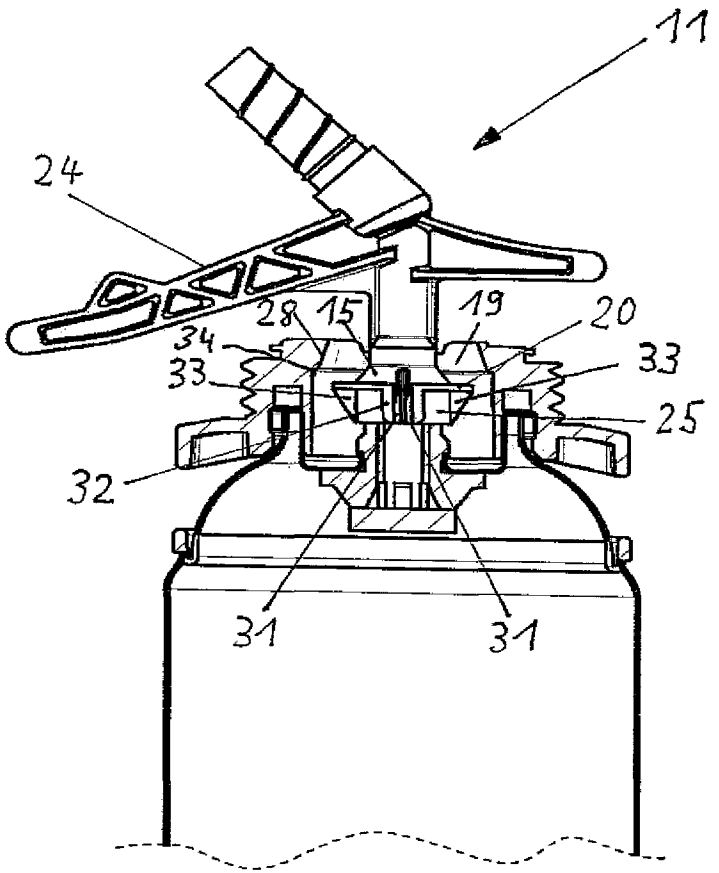
Figure 9:
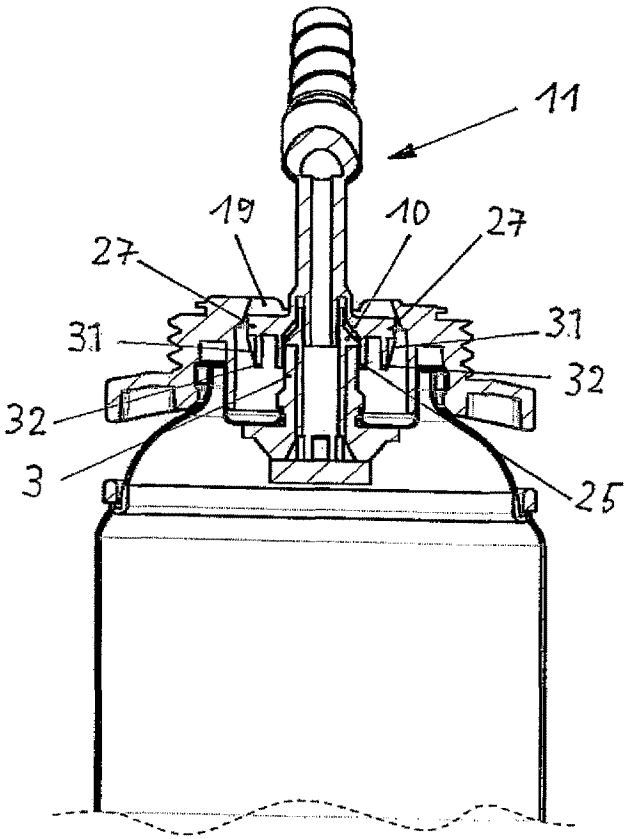
Figure 8:
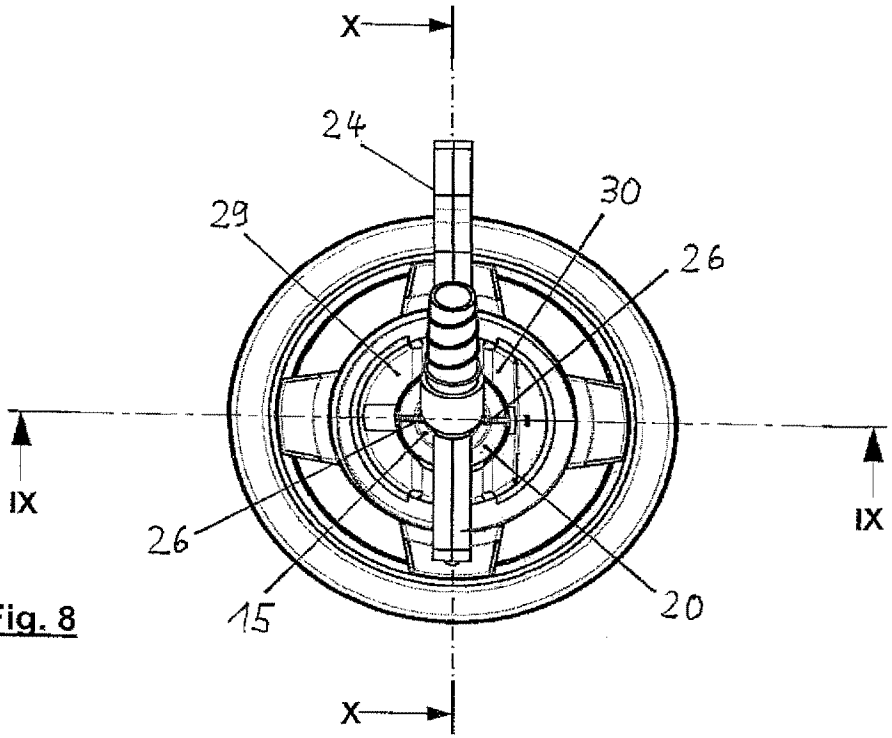
Figure 10:
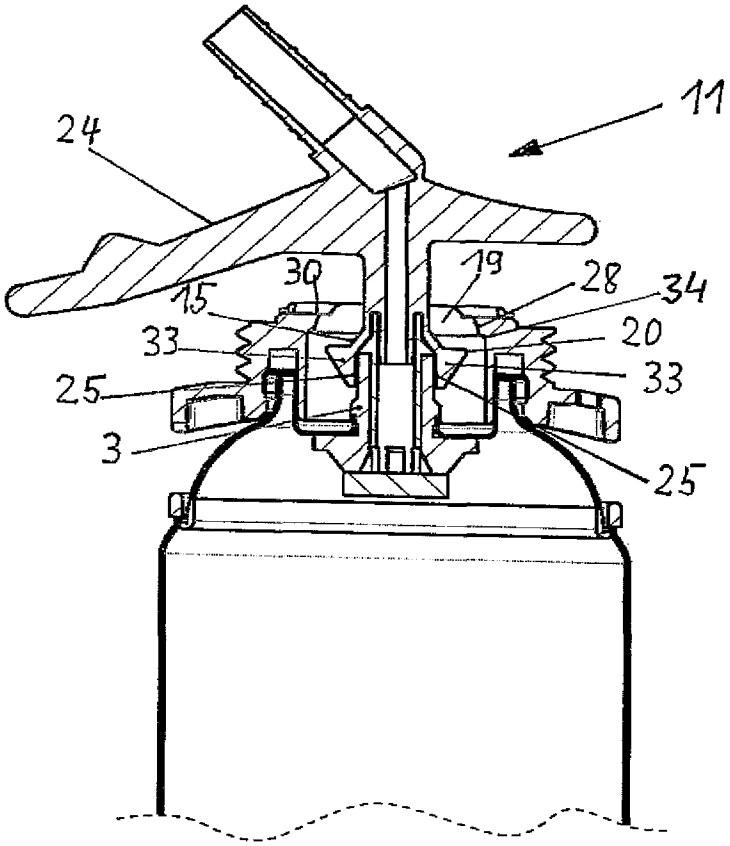
Figure 12:
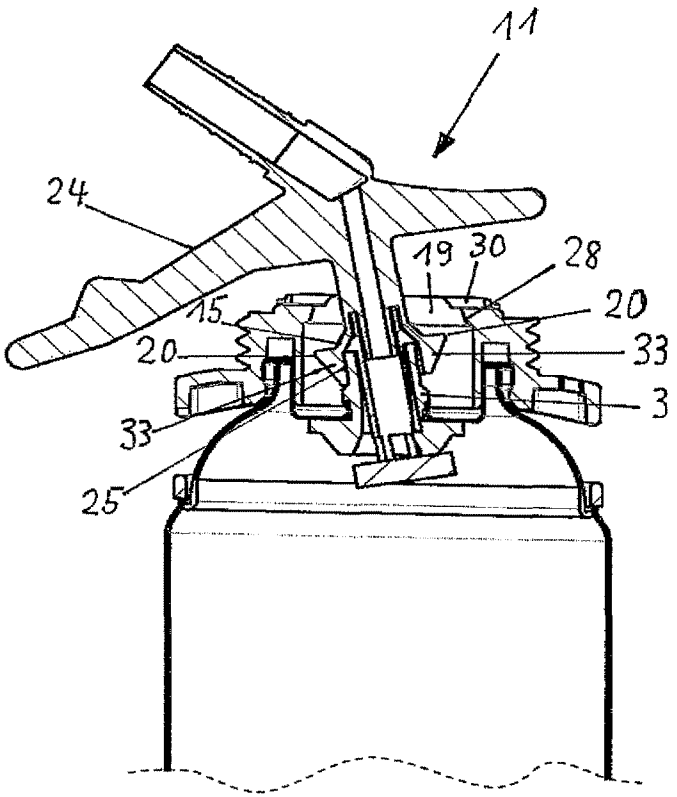
Figure 11:
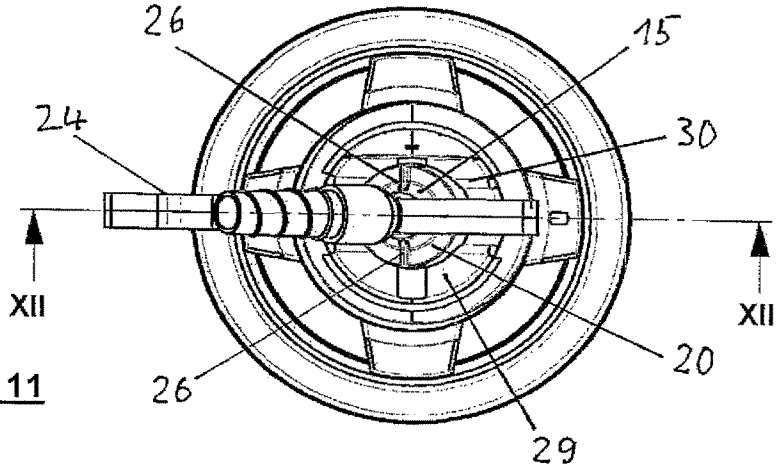

Two embodiments of the invention are described in more detail below, based on the drawing. The Figures show the following:

FIG. 1 A longitudinal section through a foam can, with tilting valve, a cap fastened on the foam can in the area of the tilting valve, and a dispenser fastened on the valve nozzle of the tilting valve, where the dispenser is in a position in the axial direction of the cap and the container in which the tilting valve is not actuated, FIG. 2 A longitudinal section analogous to FIG. 1, where the dispenser is in its tilted position in relation to the cap and the container, in which the tilting valve is actuated, FIG. 3 A top view of a foam can with a second embodiment of the invention, where the dispenser is in a first position (assembly position) in relation to the cap, in which it passes unimpeded through the opening in the cap by means of its fastening area and is fitted onto the valve nozzle and the sealing part of the foam can, FIG. 4 A longitudinal section along Line IV-IV in FIG. 3, FIG. 5 A top view of the foam can according to the second embodiment of the invention, the only difference compared to FIG. 3 being section lines VI-VI and VII-VII, where the sections each run round the dispenser radially on the outside in the opening of the cap, FIG. 6 A longitudinal section along Line VI-VI in FIG. 5, where the section runs around the dispenser radially on the outside in the opening of the cap, FIG. 7 A longitudinal section along Line VII-VII in FIG. 5, where the section runs around the dispenser radially on the outside in the opening of the cap, FIG. 8 A top view of the foam can according to the second embodiment of the invention, where the dispenser is rotated through 90° relative to the position (assembly position) shown in FIGS. 3 and 5, into a position (actuating position) in which the bayonet-type locking means of the dispenser and the cap interact, FIG. 9 A longitudinal section along Line IX-IX in FIG. 8, FIG. 10 A longitudinal section along Line X-X in FIG. 8, FIG. 11 A top view of the foam can according to the second embodiment of the invention, where the dispenser is pivoted out of the actuating position shown in FIGS. 8 to 10, into its tilted position relative to the cap, and FIG. 12 A longitudinal section along Line XII-XII in FIG. 11.

In FIGS. 1 and 2, 1 denotes a container in which a pressurised or pressurisable medium can be present.

Container 1 displays a tilting valve 2, encompassing a sealing part 3, connected to container 1, and a valve nozzle 4, interacting with sealing part 3. Sealing part 3 is fastened on container 1 by means of a clamping ring 5, which interacts with a beaded rim 6 of the container, a sealing ring 7 being inserted.

The upstream end of valve nozzle 4 displays a radially extending flange 8, which lies on the upstream face end of sealing part 3 under pretension. The wall of valve nozzle 4 is provided with several openings 9, through which the pressurised medium can flow out of container 1 and into valve nozzle 4 when tilting valve 2 is opened.

FIG. 2 shows tilting valve 2 in its tilted position, as described in more detail below. In the left-pointing tilted position shown in FIG. 2, the left-hand area of flange 8 of valve nozzle 4 is lifted off sealing part 3, such that the pressurised medium in the container can get through this area to openings 9 and flow through them into valve nozzle 4.

As can furthermore be seen from FIGS. 1 and 2, valve nozzle 4 displays a conical annular flange 10, opposite flange 8, that lies on the downstream face end of sealing part 3 under pretension, such that elastic sealing part 3 is clamped between flange 8 and conical annular flange 10.

11 denotes a dispenser, the upstream end of which displays a fastening area 12, by means of which it is fastened on the downstream end of valve nozzle 4 of tilting valve 2. Dispenser 11 is provided with an inner channel 13, the upstream end of which runs into a tubular area 14. The outside diameter of tubular area 14 decreases towards the upstream end, such that it can be inserted into the downstream tubular end area of valve nozzle 4 and fastened in it by means of an interference fit.

Fastening area 12 of dispenser 11 is furthermore provided with a conical area 15 that widens towards its upstream end. Provided between conical area 15 and tubular area 14 of fastening area 12 of dispenser 11 is an annular groove 16 that is open towards its upstream end and in which the tubular end area of valve nozzle 4, projecting downstream, is mounted by means of an interference fit.

17 denotes a cap that is fastened on beaded rim 6 of container 1. The outer circumference of cap 17 displays an external thread 18, onto which a commercially available spray gun can be screwed by means of an internal thread located in the area of its upstream end. The cap is provided with a central opening 19, the edge of which is located around valve nozzle 4 of tilting valve 2.

In order to be able to fit dispenser 11 onto valve nozzle 4 on a container 1 provided with a cap 17, and remove it again, the diameter of opening 19 of the cap, which is circular in this instance, is dimensioned to be roughly equal to, or greater than, the maximum outside diameter of fastening area 12 of dispenser 11. When in its position oriented axially to opening 19 and container 1, as shown in FIG. 1, dispenser 11 can, without being impeded by cap 17, be fastened on valve nozzle 4 through opening 19 by means of its fastening area 12, and removed from it again in the axial direction.

In order to guarantee, in addition to the interference fit of dispenser 11 on valve nozzle 4, an optimum hold of the dispenser on the valve nozzle in the tilted position of the dispenser, in which the tilting valve is actuated and the medium to be sprayed or injected passes through the valve nozzle into inner channel 13 of the dispenser under pressure, the outer area of fastening area 12 of the dispenser and the inner area of opening 19 of cap 17 display positively interacting areas that, in the tilted position of dispenser 11, create a positive fit opposing removal of the dispenser in the axial direction and detachment of the fastening area of the dispenser from the valve nozzle. To this end, the radial outer side of conical area 15 of fastening area 12 is provided with an all-round projection in the form of an annular flange 20 that engages an undercut on the inner side of opening 19 of cap 17 when the dispenser is in its tilted position, as shown in FIG. 2. In the embodiment in question, the undercut is formed by a cylindrical expansion of opening 19. Opening 19 thus comprises a cylindrical area, located on its downstream end, that passes via a shoulder-type area 22 into the expanded cylindrical area 21.

The shape of shoulder-type area 22 is such that, during tilting movement of dispenser 11 from the axial orientation relative to cap 17 and container 1, shown in FIG. 1, into the tilted position shown in FIG. 2, flange 20 reaches under the undercut, i.e. into shoulder-type area 22, with only very little play. Shoulder-type area 22 is thus of convex design in the longitudinal section of cap 17, particularly having approximately the shape of an arc of a circle in relation to the centre of the tilting movement of dispenser 11 with tilting valve 2.

As can be seen from FIGS. 1 and 2, dispenser 11 displays, following on from the downstream end of inner channel 13, a tubular connecting piece 23 for a hose or a tube, not shown in the drawing, through which the medium to be sprayed or injected can be guided to its application area.

Furthermore, a T-shaped actuating arm 24 is provided on dispenser 11, via which the tilting movement of dispenser 11 can be brought about manually.

In the embodiment shown in FIGS. 3 to 12, a bayonet lock is provided between dispenser 11 and cap 17 to give dispenser 11 extra hold in addition to the measure described above and illustrated in FIGS. 1 and 2. The bayonet lock is designed in such a way that, in its assembly position in relation to container 1 with cap 17 fastened on it, dispenser 11 can be inserted unimpeded through central opening 19 of cap 17 and fitted onto valve nozzle 4. As a result of subsequent rotation of dispenser 11 through 90°, from the aforementioned assembly position into the actuating position, in which it can be brought into its tilted position by pressing down actuating arm 24, the bayonet-type locking means of dispenser 11 and cap 17 interact, such that the dispenser is additionally protected against removal in the axial direction of the tilted position and detachment of fastening area 12 from valve nozzle 4.

Apart from the bayonet-type locking means provided on dispenser 11 and cap 17, dispenser 11 and cap 17 are fundamentally designed in the same way as in the first embodiment, described above and illustrated in FIGS. 1 and 2. In particular, fastening area 12 of dispenser 11 displays a conical area 15, widening towards its upstream end, that extends over conical annular flange 10 of the valve nozzle.

In the second embodiment considered here, conical area 15 is additionally followed, on its upstream-facing side, by an area 25 in the form of a cylindrical jacket, which extends over a downstream end area of sealing part 3 of the foam can, as can particularly be seen from FIGS. 6, 7 and 9.

Provided in the transitional area between conical area 15 and area 25 in the form of a cylindrical jacket of fastening area 12 of dispenser 11 is a radially outward-projecting annular flange 20, which can likewise particularly be taken from FIGS. 6 and 7. Provided on the downstream-facing side of annular flange 20 are radial webs 26, whose radially outward-lying ends extend beyond annular flange 20 as projections 27 and which form the bayonet-type locking means of dispenser 11, as explained in more detail below.

The two webs 26 with projections 27 are located on annular flange 20 at diametrically opposite points in relation to the axis of annular flange 20, specifically at a circumferential angle of 90° relative to actuating arm 24, provided on dispenser 11. As can also be seen from FIG. 6, the radially inward-facing ends of webs 26 are connected to conical area 15 of fastening area 12 of dispenser 11.

As the bayonet-type locking means of dispenser 11, projections 27 of webs 26 interact as follows with bayonet-type locking means of cap 17.

As can particularly be seen from FIGS. 7 and 9, the downstream end area of the edge of central opening 19 of cap 17 displays a downstream-oriented conical constriction 28. Provided on the downstream-pointing face end 29 of cap 17 is a depression 30, extending over central opening 19, the effect of which is that the diameter of opening 19 is larger in the area of depression 30 than the diameter of opening 19 beyond depression 30. The depression can be taken from FIGS. 5 and 6, for example. The enlargement of the diameter of opening 19 of cap 17 can also be seen by comparing FIGS. 6 and 7, for example.

The outside diameter of fastening area 12 of dispenser 11 in the area of projections 27 of webs 26 is, with slight play, smaller than the smallest diameter of central opening 19 of cap 17 in the area of depression 30. In the area beyond depression 30, the smallest diameter of opening 19 is smaller than the outside diameter of fastening area 12 of dispenser 11 in the area of projections 27. Consequently, the maximum outside diameter of fastening area 12 of dispenser 11 is roughly equal to, or less than, the maximum diameter of central opening 19 of cap 17.

In the assembly position of dispenser 11 shown in FIGS. 3 to 7, dispenser 11 is inserted in central opening 19 of cap 17 and fitted on valve nozzle 4 by means of its fastening area 12 in such a way that projections 27 of webs 26 point towards the edge area of opening 19 displaying depression 30. In this position, the dispenser can thus be passed unimpeded through opening 19 by means of its fastening area and fitted onto valve nozzle 4.

After rotation of the dispenser about the longitudinal axis of valve nozzle 4, from the assembly position described above and shown in FIGS. 3 to 7 into the actuating position shown in FIGS. 8 to 10, projections 27 of webs 26 of fastening area 12 reach under the edge areas of opening 19 with a smaller inside diameter, as a result of which fastening area 12 of dispenser 11 is prevented from being detached from valve nozzle 4 and simultaneously removed from opening 19. The resultant hold of dispenser 11 can particularly be taken from FIG. 9.

As can be seen from FIGS. 10 and 12, the bayonet lock described above does not impede tilting movement of dispenser 11 from the assembly position (see FIG. 10) to the tilted position (see FIG. 12). The bayonet lock is also maintained during tilting movement and in the tilted position of dispenser 11, in that projections 27 of webs 26 of fastening area 12 of dispenser 11 reach under the edge areas of central opening 19 with a smaller inside diameter.

As can furthermore be seen from FIGS. 6 and 7, two webs 31 are in each case provided on the upstream side of projections 27 of webs 26 of fastening area 12 of dispenser 11, which extend upstream from projections 27 and whose radially outward-lying sides are inclined radially inwards in the upstream direction. Webs 31 serve as insertion aids when inserting fastening area 12 of dispenser 11 into opening 19 of cap 17.

As can likewise be seen from FIGS. 6 and 7, webs 31 are located on the radial outer side of plate-like parts 32, which are integrally moulded on the upstream-facing side of annular flange 20 of fastening area 12.

Furthermore located between annular flange 20 and area 25 in the form of a cylindrical jacket of fastening area 12 of dispenser 11, and at an angle of 90° to projections 27 on webs 26, are ribs 33, extending in the upstream direction, which likewise serve as insertion aids when inserting fastening area 12 in the area of the smaller diameter of opening 19 beyond depression 30, since their radially outer edges are inclined radially inwards in the upstream direction. Ribs 33 additionally serve to reinforce the seat of annular flange 20 on fastening area 12 of dispenser 11.

As shown by the top views in FIGS. 3, 5, 8 and 11, depression 30 is essentially mirror-symmetrical relative to the plane lying axially to opening 19 and perpendicularly to the plane in which tilting movement of dispenser 11 is performed. Beyond this, depression 30 is also designed to be essentially mirror-symmetrical relative to the plane in which tilting movement of dispenser 11 is performed. Depression 30 extends beyond the downstream-pointing face end 29 of cap 17 in the radial direction. The edges of depression 30 facing in the circumferential direction of opening 19 extend essentially in a parallel direction.

As can be seen from the sectional representations in FIGS. 7 and 10, for example, the area of the edge of opening 19 of cap 17 displaying conical constriction 28 is provided with a circumferentially extending undercut 34 on its upstream end. The purpose of undercut 34 is that, as shown in FIG. 12, the radially outward-lying edge area of annular flange 20 of fastening area 12 reaches under the edge area of opening 19 displaying conical constriction 28 when dispenser 11 is in the tilted position, thus positively interacting with the inner area of opening 19 to oppose removal of dispenser 11 in the axial direction of the tilted position.

LIST OF REFERENCE NUMBERS

1 Container
2 Tilting valve
3 Sealing part
4 Valve nozzle
5 Clamping ring

6 Beaded edge
7 Sealing ring
8 Flange
9 Opening
10 Annular flange
11 Dispenser
12 Fastening area
13 Channel
14 Tubular area
15 Conical area
16 Annular groove
17 Cap
18 External thread
19 Opening
20 Flange
21 Cylindrical area
22 Shoulder-type area
23 Connecting piece
24 Actuating arm
25 Area in the form of a cylindrical jacket
26 Web
27 Projection
28 Conical constriction
29 Face end
30 Depression
31 Web
32 Plate-like part
33 Rib
34 Undercut

The invention claimed is:

1. A system comprising:

a cap for fastening on a container that contains a pressurized or pressurizable medium, wherein the container displays a tilting valve comprising a sealing part that can be connected to the container and a valve nozzle interacting with the sealing part, wherein the valve nozzle displays a radially extending flange, which lies on the upstream face end of the sealing part, that is lifted off one side of the sealing part when tilted, and wherein the cap is fastenable on the container in the area of the tilting valve; and a dispenser having a fastening area which can be fastened on the valve nozzle through a central opening of the cap, such that the tilting valve can be actuated by tilting movement of the dispenser, wherein an edge of the central opening of the cap and the fastening area of the dispenser are designed such that the fastening area can be passed through the central opening in the axial direction relative to the opening and the container when the tilting valve is closed and the dispenser is in a first rotational position, such that the valve nozzle and the dispenser are secured together at the fastening area, the dispenser being removable in the axial direction from the valve nozzle through the central opening when the dispenser is in the first rotational position and while the cap is retained on the container, wherein an inner area of the central opening of the cap and an outer area of the fastening area of the dispenser include positively interacting areas that, in a tilted position of the dispenser relative to the container, for actuating the tilting valve when the dispenser is in the first rotational position, create a positive fit opposing removal of the dispenser in the axial direction of the tilted position and detachment of the fastening area of the dispenser from the valve nozzle of the tilting valve; and wherein the outer area of the fastening area comprises a continuously annular fastening flange, the fastening area of the dispenser further comprising a tubular area, projecting upstream and spaced apart from the annular fastening flange to define an annular groove for receiving, by an interference fit, a tubular end area, projecting downstream, of the valve nozzle of the tilting valve.

2. The system according to claim 1, characterized in that an inner side of the opening of the cap displays a radial undercut in the direction of the tilting movement of the dispenser, and the dispenser is provided with a projection in the fastening area that engages the undercut during fastening of the dispenser on the valve nozzle and actuation of the tilting valve by tilting movement of the dispenser.

3. The system according to claim 2, characterized in that the projection on the fastening area of the dispenser can be guided under the undercut of the inner area of the opening of the cap in sliding fashion when the cap is fastened on the container and the dispenser is fastened on the valve nozzle and during tilting movement of the dispenser for actuating the tilting valve.

4. The system according to claim 1, characterized in that the tubular area of the dispenser includes an outside diameter that decreases towards an upstream end.

5. The system according to claim 1, characterized in that the tubular area of the fastening area of the dispenser is designed such that, when the dispenser is fastened on the valve nozzle by an interference fit, the dispenser cannot be detached from the valve nozzle in its tilted position, even when the cap is disassembled from the container.

6. The system according to claim 1, characterized in that the fastening area of the dispenser includes a conical area, widening towards an upstream end, on the end of which is located the positively interacting area of the dispenser.

7. The system according to claim 6, characterized in that the fastening area of the dispenser displays an annular groove, open towards an upstream end, that is located between the conical area and a tubular area of the fastening area of the dispenser, and is designed such that a tubular end area, projecting downstream, of the valve nozzle of the tilting valve can be inserted into the tubular end area with an interference fit.

8. The system of claim 1, further comprising a container, configured to retain a pressurized or pressurizable medium, with a tilting valve comprising a sealing part connectable to the container and a valve nozzle interacting with the sealing part, assembled with the cap and the dispenser.

9. A dispenser for a container configured to retain a pressurized or pressurizable medium, wherein the container displays a tilting valve comprising a sealing part that can be connected to the container and a valve nozzle interacting with the sealing part, wherein the dispenser can be fastened on the valve nozzle by a fastening area of the dispenser, such that the tilting valve can be actuated by tilting movement of the dispenser, wherein the valve nozzle displays a radially extending flange, which lies on the upstream face end of the sealing part, that is lifted off one side of the sealing part when tilted, and wherein a cap can be fastened on the container in the area of the tilting valve, said cap displaying a central opening, through which the dispenser can be fastened on the valve nozzle by the fastening area of the dispenser, wherein the fastening area of the dispenser comprises a continuously annular fastening flange configured to create a positive fit, by which, in a tilted position of the dispenser relative to the container and together with the cap, the positive fit opposes removal of the dispenser in the axial direction of the tilted position and detachment of the fastening area of the dispenser from the valve nozzle of the tilting valve, the fastening area further comprising a tubular area spaced apart from the annular fastening flange to define an annular groove sized to receive a tubular end portion of the valve nozzle therein, such that the tubular area is received in an opening of the valve nozzle, and the annular fastening flange engages an outer surface of the valve nozzle.

10. A dispenser according to claim 9, characterized in that the fastening area includes a bayonet-type locking mechanism, with which the dispenser can be passed unimpeded through the opening of the cap and placed on the valve nozzle in a first position relative to the cap, the bayonet-type locking mechanism reaching under the edge of the opening by the dispenser being rotated about a longitudinal axis relative to the cap, into a second position in which tilting movement of the dispenser into the tilted position can be performed.

11. The dispenser according to claim 10, characterized in that the fastening area includes at least one radial projection as the bayonet-type locking mechanism that can reach under the edge of the opening of the cap in the second position of the dispenser.

12. The dispenser according to claim 11, characterized in that the bayonet-type locking mechanism includes two diametrically opposite projections located on an annular flange of the fastening area.

13. A system comprising:

a cap for fastening on a container that contains a pressurized or pressurizable medium, wherein the container displays a tilting valve comprising a sealing part that can be connected to the container and a valve nozzle interacting with the sealing part, wherein the valve nozzle displays a radially extending flange, which lies on the upstream face end of the sealing part, that is lifted off one side of the sealing part when tilted, and wherein the cap is fastenable on the container in the area of the tilting valve; and a dispenser having a fastening area which can be fastened on the valve nozzle through a central opening of the cap, such that the tilting valve can be actuated by tilting movement of the dispenser, characterized in that the central opening of the cap includes an inner radial edge portion, wherein the fastening area includes a bayonet-type locking mechanism, with which the dispenser can be passed unimpeded through the central opening of the cap and placed in an installed axial position on the valve nozzle in a first rotational position relative to the cap, the bayonet-type locking mechanism reaching under the inner radial edge portion by the dispenser being rotated about a longitudinal axis relative to the cap, into a second rotational position in the installed axial position, in which tilting movement of the dispenser into the tilted position can be performed, and wherein the central opening of the cap and an outer area of the fastening area of the dispenser include positively interacting areas that, in a tilted position of the dispenser relative to the container, for actuating the tilting valve when the dispenser is in the second rotational position, create a positive fit further opposing removal of the dispenser in the axial direction of the tilted position and detachment of the fastening area of the dispenser from the valve nozzle of the tilting valve.

14. The system of claim 13, wherein the fastening area of the dispenser comprises an annular fastening flange.

15. The system of claim 14, wherein the bayonet-type locking mechanism comprises projections extending radially outward from the annular fastening flange.

16. The system of claim 13, wherein the fastening area of the dispenser further comprises a tubular area spaced apart from the annular fastening flange to define an annular groove sized to receive a tubular end portion of the valve nozzle therein.

17. The system of claim 13, further comprising a container, configured to retain a pressurized or pressurizable medium, with a tilting valve comprising a sealing part connectable to the container and a valve nozzle interacting with the sealing part, assembled with the cap and the dispenser.

* * * * *